United States Patent [19]

Schultz

[11] 4,120,431

[45] Oct. 17, 1978

[54] TIP SEAL DISPENSER VALVE FOR A PRESSURIZED CONTAINER

[75] Inventor: Robert S. Schultz, Old Greenwich, Conn.

[73] Assignee: The Risdon Manufacturing Company, Naugatuck, Conn.

[21] Appl. No.: 763,412

[22] Filed: Jan. 28, 1977

[51] Int. Cl.[2] ..... B65D 83/14

[52] U.S. Cl. ..... 222/518; 239/456

[58] Field of Search ..... 222/149, 322, 398, 402.12, 222/402.14, 402.15, 402.24, 503, 510, 514, 518, 559; 239/117, 118, 456, 459; 251/319, 321

[56] References Cited

U.S. PATENT DOCUMENTS

| | | | |
|---|---|---|---|
| 234,035 | 11/1880 | Houts | 222/518 |
| 670,509 | 3/1901 | Erwin | 222/518 |
| 681,272 | 8/1901 | Sides | 222/149 |
| 2,637,468 | 5/1953 | Wekerle | 222/510 X |
| 2,711,271 | 6/1955 | Schlicksupp | 222/514 X |
| 3,268,123 | 8/1966 | Spatz | 222/559 X |
| 3,777,947 | 12/1973 | Klema | 222/559 X |

*Primary Examiner*—Stanley H. Tollberg

*Assistant Examiner*—Fred A. Silverberg

*Attorney, Agent, or Firm*—St. Onge Mayers Steward & Reens

[57] ABSTRACT

A tip seal dispenser valve for a pressurized container of a viscous product comprises a valve body, mountable with the container, which includes a hollow valve conduit that defines an outlet orifice and is in fluid communication with the interior of the container. The valve body also includes a hollow actuator channel laterally displaced from the valve conduit. A valve core, formed with a sealing tip, is mounted for axial reciprocal movement in the conduit between a closed position with the tip blocking the outlet orifice and an open position with the tip withdrawn inwardly from the orifice. A fin arrangement guides the core for proper movement in the conduit so that the tip correctly seats in the outlet orifice when closed. The valve core is operated by an actuator button, mounted for axial reciprocal movement in the actuator channel, that is linked to the core so that movement of one causes movement of the other. Further, a seal is associated with the actuator button and channel to prevent leakage thereby.

8 Claims, 8 Drawing Figures

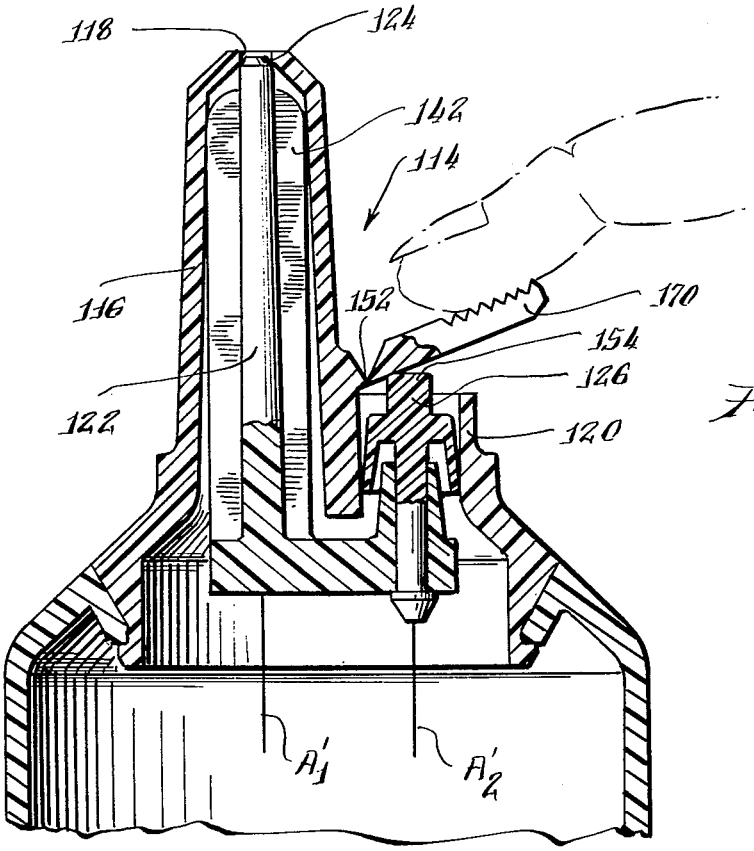
Fig. 4.
Fig. 5.
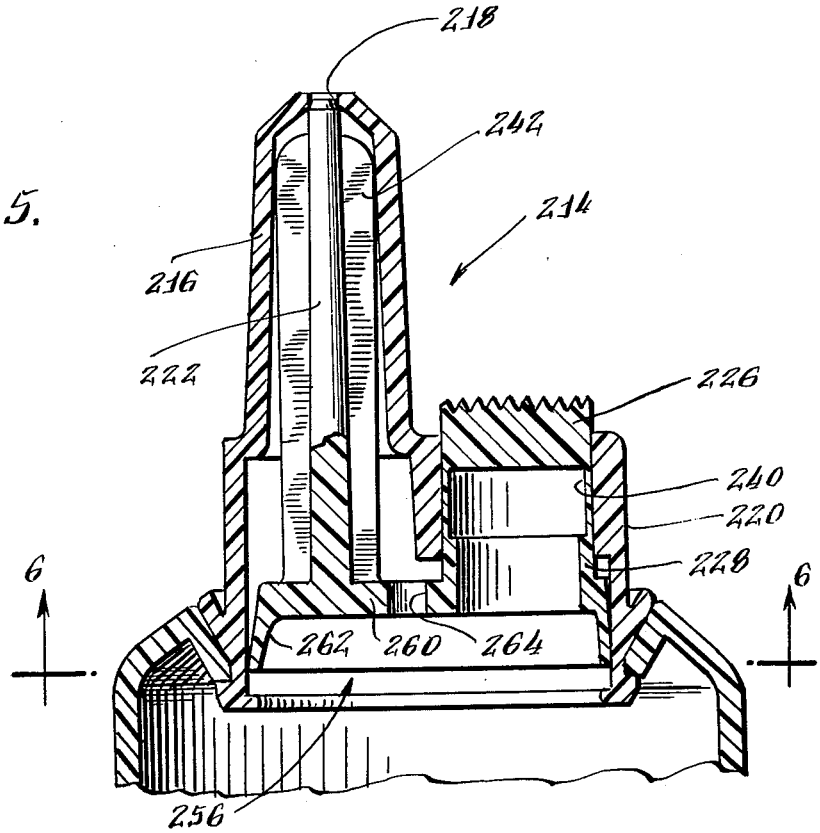

TIP SEAL DISPENSER VALVE FOR A PRESSURIZED CONTAINER

BACKGROUND OF THE INVENTION

1. Field of the Invention

The present invention relates to a tip seal dispenser valve for a pressurized container of viscous products such as viscous foods, household products, pharmaceuticals, cosmetics, and toiletries.

It is desirable to dispense certain products in a manner which preserves their sterility as well as their fluid conditon. For example, viscous medicines and other viscous pharmaceutical products such as salves, steroids, and petroleum jelly should be packaged and dispensed so that amounts which are not used remain sterile. Household products such as caulking compound, viscous glues and cements which dry out and harden when exposed to air should be packaged and dispensed so that amounts which are not used remain sealed from the atmosphere. Foods like cheeses, syrups, and desert toppings should be packaged and dispensed so that they do not become contaminated.

Further, many products are difficult to handle and use when removed from their container. It is beneficial to package these products so that they can be easily and conveniently dispensed in desired amounts and at locations where needed.

2. Desciption of the Prior Art

Most commonly used dispenser valves seat to close at a location inside of the container which packages the product to be dispensed. Once past the valve seat, the product must further travel through additional valve components before ultimately leaving the container. Therefore, product ordinarily remains in these components, is exposed to the atmosphere and, thus, is subject to contamination or hardening. This is particularly true of viscous products which do not rapidly evaporate.

Various solutions to the problem of product contamination have been proposed. One solution is found in a form of valve, typically known as a "tip seal" valve, which controls dispensing from a product container. Tip seal valves seat outwardly of the container at the point where product is dispensed. Therefore, there are no valve or container components which confine product outwardly of the valve seat where it is subject to contamination.

However, presently known tip seal valves have certain drawbacks. For example, U.S. Pat. No. 3,268,123 (Spatz) discloses a valve used in conjunction with a piston pump for a nonpressurized package. The valve includes a valve plug mounted to close a valve seat at the mouth of a nozzle. The valve plug is mounted with a piston through a lost-motion coupling to be moved to an open position prior to piston actuation. However, the plug is not firmly guided within the nozzle into sealing engagement with the valve seat. Since the Spatz device is primarily a pump rather than a valve for a pressurized container, problems of dispensing products having widely varying viscosities under continuous pressure are not considered. Similarly, problems of sealing a valve used on a pressurized container are not considered. Moreover, the Spatz device is complicated, having many moving parts, and is, therefore, expensive to make and assemble.

U.S. Pat. No. 3,777,947 (Klema) discloses a tip seal valve assembly, for a pressurized container, that includes a tubular valve body in which a piston is mounted. A portion of the piston projects out of the body through suitable slots and is engaged by an actuator tab which, when depressed, depresses the piston. This valve is also relatively complicated having a large number of parts which must be fabricated and assembled.

Still other tip seal valve constructions are disclosed in U.S. Pat. Nos. 3,406,944 (Barker); 3,450,316 (Barker); 3,489,323 (Hug); and 3,506,165 (Beard).

SUMMARY OF THE INVENTION

In its preferred embodiments, to be described below in detail, the tip seal dispenser valve of the present invention is specifically designed for use with a pressurized container of a viscous product. This valve preserves the sterility as well as the fluid condition of the product confined in the container yet facilities easy and convenient product dispensing. The internal pressure of the product is taken advantage of to seal the valve against leakage. Moreover, various forms of the respective embodiments of the present invention may be adapted specifically for dispensing different products having a wide range of viscosities. This tip seal valve is also extremely simple having few parts which may be fabricated and assembled at low cost.

In the preferred embodiments, the tip seal valve of the present invention comprises a valve body which is mountable in a pressurized container and which includes a hollow valve conduit in fluid communication with the interior of the container. An outlet orifice is defined at the outer end of the valve conduit. The valve body also includes a hollow actuator channel laterally displaced from the valve conduit. A valve core having a sealing tip is mounted in the valve conduit for axial reciprocal movement between a closed position with the core tip blocking the outlet orifice and open position with the core tip withdrawn inwardly from the outlet orifice. A guide arrangement, for example, a series of inwardly directed fins formed on the inner wall of the valve body, guides the core tip to the outlet orifice when the core is moved to its closed position.

The valve core is operated by an actuator button which is mounted for axial reciprocal movement in the actuator channel and is linked to the valve core so that depression of one depresses the other. A seal arrangement is associated with the actuator channel and button for sealing the actuator button in the channel to prevent leakage therethrough.

The tip seal dispenser valve also incorporates features which permit it to be specifically designed to dispense different products having widely varying viscosities using the same actuation pressure. In one embodiment, particularly useful for dispensing products such as caulking compound which are highly viscous making it difficult to depress the actuator button, the valve body includes a lever mounted for pivoted movement therewith to increase the mechanical advantage with which the actuator button may be operated. In another embodiment, the valve body incorporates a main metering cylinder with which both the valve conduit and actuator channel communicate. A metering piston is mounted to make a sliding fit in this cylinder and is linked to both the valve core and actuator button to guide reciprocal movement of them. The piston defines a metering orifice through which the product passes to gain access to the valve conduit and outlet orifice. The size of the metering orifice determines the amount of pressure and speed (the operating "feel" of the valve)

required to move the actuator button to in turn move the valve core to its open position.

Manufacture of this dispenser valve is simple and inexpensive. Because of the side-by-side arrangement of the valve core and actuator button, the valve body and moving components may be easily molded and assembled using conventional straight up-and-down molding techniqes. In addition, this valve may comprise as few as two components further reducing fabrication and assembly costs.

Accordingly, it is an object of the present invention to provide a tip seal dispenser valve for a pressurized container which may be adapted to dispense products having different viscosities and which may be fabricated and assembled easily and inexpensively.

Other objects, aspects, and advantages of the present invention will be pointed out in, or will be understood from, the following detailed description provided below in conjunction with the accompanying drawings.

BRIEF DESCRIPTION OF THE DRAWINGS

FIG. 4 is a vertical cross-sectional view similar to that shown in FIG. 2 of a second embodiment of the present invention which incorporates a lever to increase the mechanical advantage for depressing the actuator button.

FIG. 5 is a vertical cross-sectional view similar to that shown in FIG. 2 of a third embodiment of the present invention having a metering cylinder and a metering piston which defines a metering orifice.

DETAILED DESCRIPTION OF THE PREFERRED EMBODIMENTS

Figure 1:
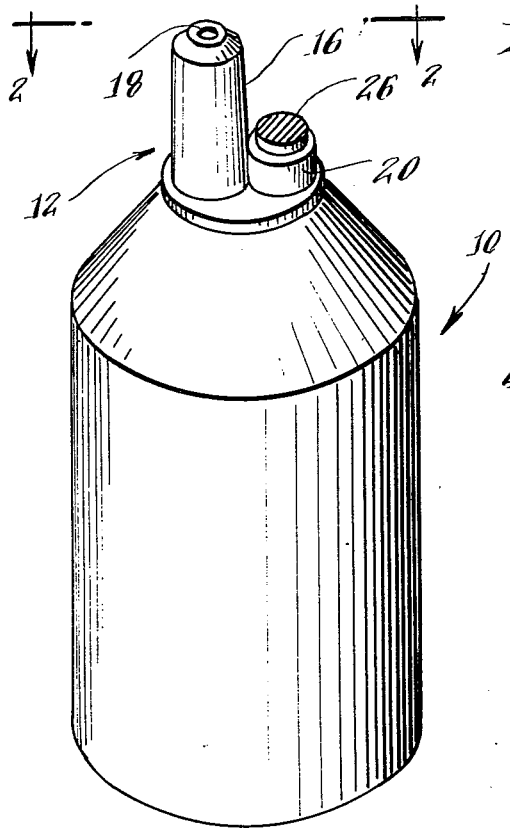
FIG. 1 is a perspective view of a pressurized container of a viscous product equipped with the tip seal dispenser valve of the present invention.

FIG. 1 illustrates a pressurized container 10 which packages a viscous product and which is equipped with the tip seal dispenser valve of the present invention, generally indicated at 12. The container may be made in conventional fashion of any suitable material such as metal or plastic and is designed to withstand substantial internal pressures of up to, for example, 200 to 300 pounds per square inch. Further, the dispenser valve 12 may be attached to the container in any of a number of well-known ways to be equally pressure-safe. Alternatively, the body of the valve, which will be described in greater detail below, may be formed integrally with the body of the container.

Figure 3:
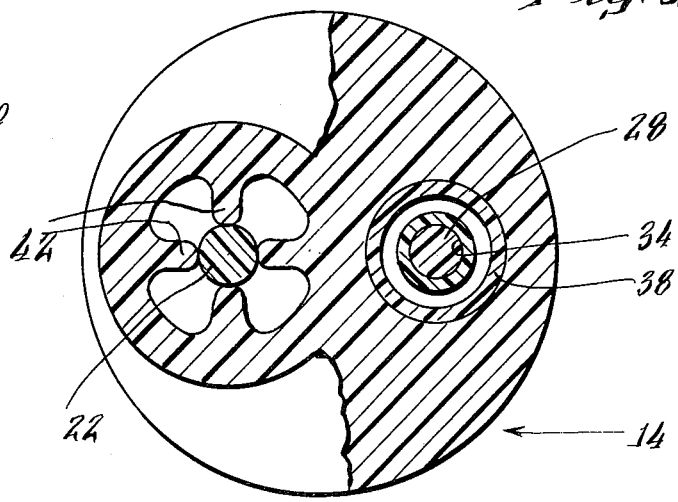
FIG. 3 is a horizontal cross-sectional view taken through plane 3—3 in FIG. 2 looking downwardly showing in detail the arrangement for guiding the valve core for movement in the valve conduit.
Figure 2:
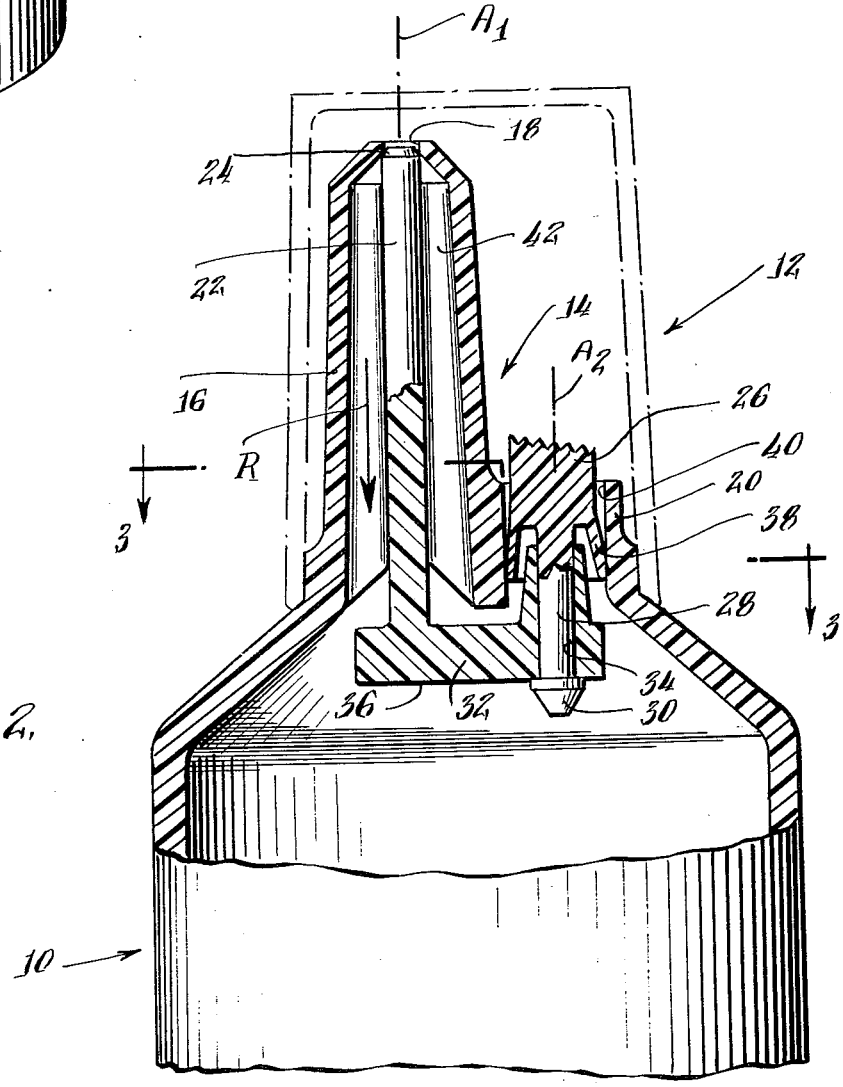
FIG. 2 is a vertical cross-sectional view of the tip seal dispenser valve taken through plane 2—2 in FIG. 1.

Referring now to FIGS. 2 and 3, the tip seal dispenser valve of the present invention comprises a valve body, generally indicated at 14, formed with a hollow valve conduit 16 in fluid communication with the interior of the container 12. At its outer end, the valve conduit defines an outlet orifice 18 through which the viscous product confined in the container is dispensed. The valve body 14 is also formed with a hollow actuator channel 20 that is laterally displaced from the valve conduit so that their respective major axes $A_2$ and $A_1$ are parallel.

A generally cylindrical valve core 22 is mounted in the valve conduit 16 for axial reciprocal movement. At its upper end, core 22 defines a generally conical sealing tip 24 which seats against the inner surface of outlet orifice 18 to close it. Accordingly, when positioned as shown in FIG. 2, the sealing tip blocks outlet orifice 18 to prevent dispensing of the viscous product from container 10. However, when reciprocated inwardly as shown by arrow R, the tip 24 is withdrawn from orifice 18 to permit viscous product to be dispensed therethrough. It can be seen, therefore, that cooperation of the valve tip 24 with outlet orifice 18 seals the interior of the container and valve conduit at their outermost location. Accordingly, when product is dispensed, no residue of product is confined in a portion of the tip seal valve where it might be exposed to the atmosphere. The product remains sterile and is preserved in fluid condition since all of it is isolated from contaminating agents which might be present in the environment of the container and valve. This tip seal valve construction is, thus, particularly well-suited for dispensing medicines and other medicinal products which must be maintained in a sterile condition, for dispensing foods which must not become contaminated, as well as for dispensing viscous products such as glue, caulking compound, and other similar agents which dry out and harden when exposed to the atmosphere.

The tip seal valve further includes an assembly for reciprocating the valve core to dispense the product so that the product need not come into contact with the hands of the operator. As shown in FIG. 2, this actuator assembly includes an actuator button 26 which is mounted for axial reciprocal movement in the actuator channel 20 and is formed with a depending steam 28 having an enlarged bulb 30 at its base. Actuator button 26 and stem 28 are linked to the valve core 22 through a laterally extending arm 32 having a stem accepting hole 34 therethrough and bulb 30 seats against the bottom surface 36 of arm 32 to prevent relative disengagement of the button and arm. Accordingly, when actuator button 26 is depressed in channel 20 in the direction of its axis $A_2$, valve core 22 is simultaneously depressed in valve conduit 16 in the direction of its axis $A_1$.

Actuator button 26 is also formed with a peripheral, depending skirt 38 that makes a sliding, sealing fit with the inner wall 40 of actuator channel 30. The internal pressure of the viscous product contained in the container forces this skirt outwardly against the actuator channel wall 40 to ensure that a positive seal is formed. Moreover, when released, the actuator button 26 acts to automatically close valve tip 24 against outlet orifice 18, since the internal pressure of the viscous product contents of the container urges the actuator button 26 and, hence, the valve core 22 upwardly. Note also that this actuator button sealing arrangement, in cooperation with the internal pressure of the container, insures that no contamination reaches the product through the actuator channel. In particular, contamination is always urged outwardly of the container by the pressure should, by chance, a leak occur.

As can be seen in FIGS. 2 and 3, the tip seal valve of the present invention is also equipped with an arrangement for preventing tilting of the valve core 22 during actuation and, hence, for preventing poor seating of the sealing tip 24 in the outlet orifice 18. This arrangement includes a series of fins 42, which project radially inwardly toward valve core axis $A_1$, that serve as a guide for the axial reciprocal movement of the valve core in the valve conduit and thus ensure proper sealing of the valve when it is closed.

The basic tip seal dispenser valve construction described above may be adapted through various modifications to effectively dispense different viscous products having widely varying viscosities. Typically, products having low viscosity need not be pressurized as greatly as those having high viscosity in order to achieve satisfactory dispening. Further, products themselves having low viscosity offer less resistance to depression of the actuator button then do those having high viscosity. Accordingly, it is desiragle to throttle the tip seal valve of the present invention or increase the resistance necessary to depress the actuator button of this valve in order to desensitize it when used to dispense products having low viscosity. This throttling aids in preventing accidental valve operation. Conversely, it is desirable to provide a means for assisting depression of the actuator button or unthrottling the tip seal valve when used to dispense a highly viscous product.

FIG. 4 illustrates a modification in the basic tip seal valve specifically designed to aid dispensing of high viscosity products. This modified design includes a valve body 114 which defines a valve conduit 116 and an actuator channel 120. A valve core 122 and actuator button 126, similar to those described with reference to FIGS. 2 and 3, are respectively mounted in the valve conduit and actuator channel. However, the valve body is formed with a lever 170 pivoted at an integral hinge 152 to operatively engage actuator button 126. This button has an upwardly projecting pin 154 which abuts the bottom surface of lever 170 at a location closely adjacent hinge 152. Thus, the pivoted lever 170 provides added mechanical advantage for depressing actuator button against a highly pressurized, highly viscous product confined in the container. Therefore, the valve operator can depress the actuator button to operate the tip seal dispenser valve as easily as if the container confined a low viscosity product pressurized to a relatively small degree. The diameter of the actuator button seal can also be varied to obtain more or less sealing pressure on the tip as well as to adjust the amount of actuating pressure which it requires.

FIG. 4 also illustrates an alternative construction for guiding the valve core 122 so that its valve tip 124 properly seats against the outlet orifice 118 in valve conduit 116. This alternative arrangement includes a plurality of fins 142 integrally formed with valve core 122 to project radially outwardly from the core axis $A_1'$. These fins function in the same fashion as do those described with reference to FIGS. 2 and 3.

Figure 6:
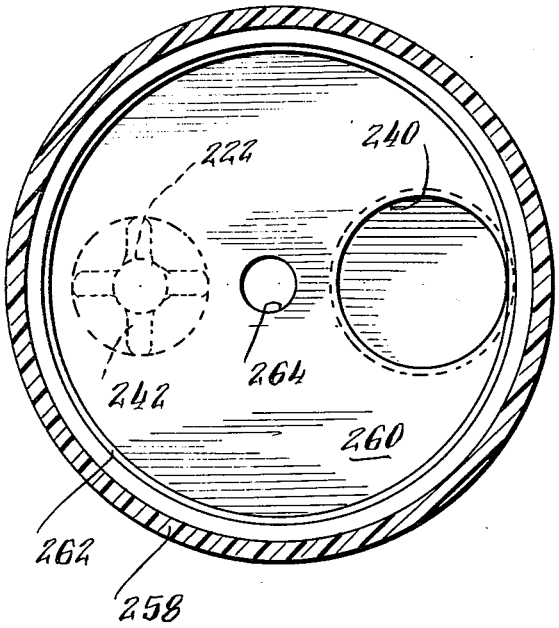
FIG. 6 is a bottom plan view taken through plane 6—6 in FIG. 5 looking upwardly.

FIGS. 5 and 6 illustrate a third embodiment of the tip seal dispenser valve of the present invention specifically designed to dispense a product having low viscosity. This embodiment includes a valve body 214 molded with a valve conduit 216 and an actuator channel 220. An integral one-piece valve member, generally indicated at 256, includes a valve core 222 formed with guide fins 242 in fashion similar to that described with reference to FIG. 4. A hollow actuator button 226, also a part of valve member 256, is positioned for axial reciprocal movement in the actuator channel 220 and includes a depending skirt 228 which makes a sliding sealing fit with the inner channel wall 240. Again, internal pressure of the viscous product forces skirt 228 outwardly to increase its sealing efficiency.

This third embodiment also incorporates a actuator back-pressure generating arrangement. Specifically, valve body 214 is formed with a main metering cylinder 258, and a main metering piston 260 molded at the base of both the valve core 222 and button 226, is mounted for reciprocal movement therein. Piston 260 is provided with a depending skirt 262 which makes a sliding, sealing fit with cylinder 258. A metering orifice 264, shown in detail in FIG. 6, is disposed through piston 260 and serves as a means for throttling the viscous product to being dispensed through outlet orifice 218. The amount of resistance to depression of the valve member 256, namely, the actuator button 226 and valve core 222, is largely determined by the size of orifice 264. If the product being dispensed has extremely low viscosity, the metering orifice 264 is decreased in size so that added pressure must be exerted on actuator button 226 in order to depress it and the valve core 222. Conversely, if the product has higher viscosity, orifice 264 is increased in size so that less resistance to depression of actuator button 226 is offered.

Accordingly, the tip seal dispenser valve of the present invention may be adapted to dispense products having widely varying viscosities by adjusting the size of metering orifice 264, by providing a lever arrangement such as that shown in FIG. 4, or by varying the diameter of the actuator button seal as noted above.

Figure 7:
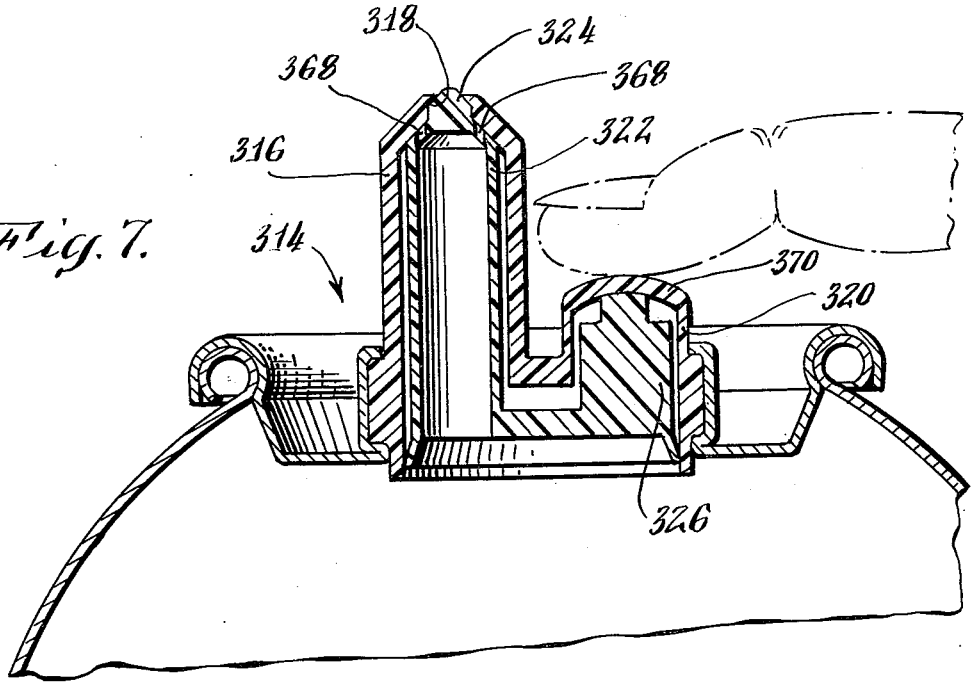
FIG. 7 is a vertical cross-sectional view of a fourth embodiment of the present invention having an actuator button which is completely sealed from the exterior of the dispenser valve.

FIG. 7 discloses a fourth embodiment of the present invention which incorporates an integral arrangement for sealing the actuator button and for providing resistance to operation of the dispenser valve. Further, this embodiment incorporates an alternative construction for guiding the valve core in the valve conduit. The dispenser valve includes a valve body 314 comprising a valve conduit 316 and an actuator channel 320. A hollow, cylindrical valve core 322 having a number of outlet passages 368 at its outer end 324, is mounted for axial reciprocal movement in the valve conduit 316 and an actuator button 326 is linked to the valve core and is mounted for axial reciprocal movement in the actuator channel 320. The outer wall of valve core 322 makes a loose sliding fit with the inner wall of valve conduit 316 to guide the outer core end or tip 324 into sealing engagement with the outlet orifice 318. This arrangement also permits the dispensing orifice to be made larger and, hence, offer less flow resistance to product conducted through in the valve core.

This fourth embodiment further includes an integral cover or cap 370 for the actuator channel which completely encloses it. The cap is flexible to be depressed downwardly to actuate the actuator button 326. Moreover, the flexibility or resistance to flexing of the cap 370 is determined by the cross-sectional shape and thickness thereof. Accordingly, by adjusting this shape and thickness, varying degrees of resistance may be provided to depression of the actuator button 320.

This fourth embodiment may be used with particular advantage with medicinal products where sterility is of the utmost concern. the Interior of this container is completely sealed but for the outlet orifice 318.

Figure 8:
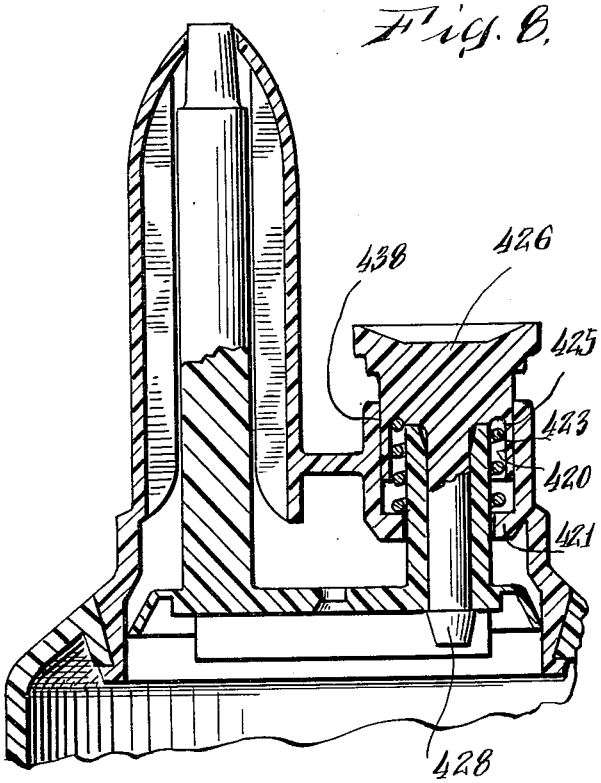
FIG. 8 is a vertical cross-sectional view of a fifth embodiment having a spring which tends to smooth operation of the valve during all conditions.

The fifth embodiment of the present invention, shown in FIG. 8, utilizes a coil spring to smooth operation and improve the "feel" of the actuator button and incorporates the valve core and guide arrangement of the embodiment shown in FIG. 1 as well as a metering piston and cylinder such as that shown in FIG. 5. However, it will be understood that features of these and other embodiments may be incorporated or deleted from the fifth embodiment as needed. The actuator channel 420 is formed with an annular ledge 421 at its lower margin. The coil spring 423 is compressed between this ledge and the bottom inner surface 425 of the actuator button 426 between the button stem 428 and the button skirt 438. The spring tends to equalize the pressure required to depress the actuator button 426 regardless of the inner pressure confined in the container. This feature has particular utility in containers of the barrier or piston type which often use compressed air as a propellant and in which the internal pressure drops significantly as the product is used.

Each of the embodiments of the present invention provides easy, convenient dispensing of viscous products which are pressurized in a container. The product is entirely isolated from the atmosphere and from contamination prior to being dispensed and no residue of product is so exposed while confined in components of the valve. Moreover, the constructions described above are extremely easy to fabricate and assemble. For example, the first two embodiments have but three parts which may be molded by conventional techniques and assembled by merely being slipped together.

The second two embodiments have two parts which also may be moled by conventional techniques and may be assembled merely by inserting the valve core and actuator button member into the valve body.

Further, this tip seal valve can be mounted with a container in many ways. As noted above, this body may be molded integrally with the container or may be attached thereto by any of a number of conventional techniques. As shown in FIG. 2 the valve body 14 may be formed integrally with the container or as shown in FIGS. 4 and 5 a snap type connection between the container and valve body may be employed. Still another alternative is shown in FIG. 7 where the valve body is crimp-connected to a metal container.

Although specific embodiments of the present invention have been described above in detail, it is to be understood that this is only for purposes of illustration. Modifications may be made to these tip seal dispenser valve embodiments by those skilled in the art in order to adapt the present invention to particular applications for dispensing pressurized viscous products.

What is claimed is:

1. A tip seal dispenser valve for a pressurized container of a viscous product, said valve comprising:

A. a valve body, mountable with the container, including 1. a hollow valve channel, in fluid communication with the interior of the container, having a major axis and defining an outlet orifice at its outer end,
2. a hollow actuator channel, laterally displaced from said valve channel, having a major axis parallel to the major axis of said valve channel,
3. a metering cylinder with which both said valve channel and actuator channel communicate, B. a valve core having a tip mounted for axial reciprocal movement in said valve channel between a closed position with said core tip blocking said outlet orifice and an open position with said core tip withdrawn from said outlet orifice, C. an actuator button mouned for axial reciprocal movement in said actuator channel, D. a piston mounted to make a sliding fit in said metering cylinder and thereby being interposed between said outlet orifice and the interior of the container and further interconnecting said valve core and actuator button to effect and guide movement of said valve core in said valve channel between said closed and open positions when said actuator button is moved, said piston having metering orifice means offset with respect to the outlet orifice through which a major portion of the viscous product passes when moving from the interior of the container to said outlet orifice to be dispensed therefrom under pressure.

2. The tip dispenser valve as claimed in claim 1 wherein said guide means comprises a plurality of fins formed with said valve core to project outwardly away from the major axis thereof and make a sliding fit with the interior surface of said valve conduit.

3. The tip seal dispenser valve as claimed in claim 1 further comprising:

means associated with said valve core and valve channel for guiding said core tip to said outlet orifice when said core is moved to its closed position.

4. The tip seal dispenser valve as claimed in claim 3 wherein said guide means comprises a plurality of fins formed with said valve channel to project inwardly toward the major axis thereof and make a sliding fit with the exterior surface of said valve core.

5. The tip seal dispenser valve as claimed in claim 1 further comprising:

means for sealing said actuator button in said actuator channel to prevent leakage therethrough.

6. The tip seal dispenser valve as claimed in claim 5 wherein said seal means comprises:

a hollow skirt formed with said actuator button to make a sliding fit with the interior surface of said actuator channel, the internal pressure confined in the container being received on the inner side of said skirt thereby pressing it outwardly into firm sealing contact with the inner wall of said actuator channel.

7. The tip seal dispenser valve as claimed in claim 1 further comprising;

a piston skirt depending from the edge of said metering piston and sized to make a sliding sealing fit in said metering cylinder.

8. The tip seal dispenser valve as claimed in claim 1 further comprising:

spring means for urging said actuator button and valve core toward the closed position.

* * * * *